US009284692B2

(12) United States Patent
Duan et al.

(10) Patent No.: US 9,284,692 B2
(45) Date of Patent: Mar. 15, 2016

(54) SWITCH MONITORING AND RAILWAY LINE MANAGEMENT

(71) Applicant: INTERNATIONAL BUSINESS MACHINES CORPORATION, Armonk, NY (US)

(72) Inventors: Ning Duan, Beijing (CN); Ke Hu, Beijing (CN); Li Li, Beijing (CN); Wen Ting Mo, Shanghai (CN); Wei Sun, Beijing (CN); Xi Sun, Beijing (CN); Feng Juan Wang, Beijing (CN)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

(21) Appl. No.: 14/925,053

(22) Filed: Oct. 28, 2015

(65) Prior Publication Data

US 2016/0047092 A1 Feb. 18, 2016

Related U.S. Application Data

(63) Continuation of application No. 14/360,768, filed as application No. PCT/CN2012/084644 on Nov. 15, 2012.

(30) Foreign Application Priority Data

Nov. 30, 2011 (CN) ..... 2011 1 0390490

(51) Int. Cl.

| | |
|---|---|
| ***B61L 23/00*** | (2006.01) |
| ***E01B 35/12*** | (2006.01) |
| ***B61L 23/04*** | (2006.01) |
| ***E01B 7/20*** | (2006.01) |

(52) U.S. Cl.
CPC ..... *E01B 35/12* (2013.01); *B61L 23/04* (2013.01); *E01B 7/20* (2013.01)

(58) Field of Classification Search
CPC ..... B61L 23/04; B61L 5/102; B61L 27/0027; B61L 27/0088
See application file for complete search history.

(56) References Cited

U.S. PATENT DOCUMENTS

| | | | | | |
|---|---|---|---|---|---|
| 3,902,690 | A | * | 9/1975 | Wanha | 246/118 |
| 5,253,830 | A | * | 10/1993 | Nayer et al. | 246/220 |
| 5,806,809 | A | * | 9/1998 | Danner | 246/220 |
| 6,164,600 | A | * | 12/2000 | Seidl et al. | 246/220 |

(Continued)

FOREIGN PATENT DOCUMENTS

| | | | |
|---|---|---|---|
| CN | 1381371 | A | 11/2002 |
| CN | 1799912 | A | 7/2006 |

(Continued)

*Primary Examiner* — Jason C Smith
(74) *Attorney, Agent, or Firm* — Jeff Tang

(57) ABSTRACT

The present invention relates to a switch monitoring method and a switch monitoring system, a railway line management method and a railway line management system. Electric signal of a switch motor during pulling of the switch can effectively reflect status of the switch, when the switch is in a stable state, electric signal of its motor is very steady during pulling of the switch; however, when the switch is in an unstable state, there will be different degrees of fluctuation in electric signal of its motor during pulling of the switch. Thus, the invention may be used to identify state of a switch by monitoring electric signal of a switch motor, and further take different measures based on different states of the switch. With these measures, accidents due to switch failure may be effectively reduced, and train delay time may also be reduced through proper line management.

24 Claims, 9 Drawing Sheets

(56) References Cited

U.S. PATENT DOCUMENTS

| | | | | |
|---|---|---|---|---|
| 7,530,535 | B2 * | 5/2009 | Fox | 246/452 |
| 7,699,272 | B2 * | 4/2010 | Arnold | 246/220 |
| 7,735,784 | B2 * | 6/2010 | Schalk | 246/476 |
| 8,152,111 | B1 * | 4/2012 | Bryan | 246/220 |
| 8,695,928 | B1 * | 4/2014 | Schalk | 246/476 |
| 2009/0105893 | A1 * | 4/2009 | Kernwein | 701/19 |
| 2010/0148805 | A1 * | 6/2010 | Imhoff | 324/678 |
| 2011/0064273 | A1 * | 3/2011 | Zarembski et al. | 382/104 |
| 2012/0091288 | A1 * | 4/2012 | Rosetti et al. | 246/415 R |
| 2012/0263342 | A1 * | 10/2012 | Haas et al. | 382/100 |
| 2014/0312180 | A1 * | 10/2014 | Bohme | 246/415 R |
| 2014/0312181 | A1 * | 10/2014 | Duan et al. | 246/415 R |
| 2015/0145962 | A1 * | 5/2015 | Jeong et al. | 348/47 |

FOREIGN PATENT DOCUMENTS

| | | | |
|---|---|---|---|
| CN | 101306693 | A | 11/2008 |
| CN | 101439725 | A | 5/2009 |
| CN | 101513884 | A | 8/2009 |
| CN | 201329879 | | 10/2009 |
| CN | 101893667 | A | 11/2010 |
| CN | 101917237 | A | 12/2010 |
| DE | 29610174 | U1 | 8/1996 |
| DE | 10023093 | A1 | 12/2001 |
| EP | 0344145 | A1 | 11/1989 |
| EP | 2165915 | A2 | 3/2010 |
| GB | 2392987 | A | 3/2004 |
| JP | H1111315 | A | 1/1999 |

* cited by examiner

SWITCH MONITORING AND RAILWAY LINE MANAGEMENT

CROSS-REFERENCE TO RELATED APPLICATIONS

This application is a continuation of U.S. patent application Ser. No. 14/360,768 filed on May 27, 2014, which is a National Phase Application based on PCT/CN2012/084644 filed on Nov. 15, 2012, which claims priority from Chinese Patent Application No. 201110390490.7 filed on Nov. 30, 2011, the entire contents of each which are incorporated herein by reference.

TECHNICAL FIELD OF THE INVENTION

The present invention generally relates to a method and system of managing railway, and more particularly, the present invention relates to a switch monitoring method and a switch monitoring system, a railway line management method and a railway line management system.

BACKGROUND OF THE INVENTION

Switch is a line connection device that transfers a locomotive from one line to another and is widely used in railway, mine road. Pass-through capability of a line can be fully exploited with the help of switch. Switch is a huge family, the most common one is ordinary single switch, which is composed of three units: converter, connecter, frog and guard rail. The converter comprises basic rail, point rail and converter mechanism. Besides single switch, there are also double switch, triple switch and multiple switch (multiple cross switch) and so on. The switch has features such as large number (number of switches in a station larger than medium size often approaches thousands of groups, for example), complicated structure, short service life, high failure frequency, high maintenance cost etc.

Switch failure is divided into indoor failure and outdoor failure, the former is primarily the failure of motor per se and the latter is the failure while the switch is pulled or in use. Generally, since switch device is exposed at outdoor for a long period of time, it is frequently interfered by outside factors and its rate of failure is much higher than that of indoor switch.

Switch failure will bring severe property loss and human casualty; however, it is very difficult to accurately estimate and predict a switch failure in practice, it is thus difficult to take measures to prevent an accident from happening before a switch failure. Human maintenance and inspection on switch is manpower consuming, and often it is difficult to be conducted in day time due to time limit.

SUMMARY OF THE INVENTION

In order to identify state of a switch, the present invention proposes a switch monitoring scheme, which comprises a switch monitoring method and a switch monitoring system. In order to perform line management, the present invention also proposes a line management scheme, which comprises a line management method and a line management system, so as to realize line management by using the switch monitoring scheme.

Specifically, the present invention provides a switch monitoring method, comprising: monitoring electric signal of a switch motor; acquiring switch state identification threshold; and identifying state of the switch based on the electric signal and the switch state identification threshold.

The present invention also provides a line management method, comprising: monitoring a switch according to the switch monitoring method to identify state of the switch; deciding whether to adjust pulling plan of the switch based on state of the switch; and adjusting pulling plan of the switch in response to a need of adjusting pulling plan of the switch.

The present invention also provides a switch monitoring system, comprising: a monitoring means configured to monitor electric signal of a switch motor; an acquiring means configured to acquire switch state identification threshold; and an identifying means configured to identify state of the switch based on the electric signal and the switch state identification threshold.

The present invention also provides a line management system, comprising: the switch monitoring system; an deciding means configured to decide whether to adjust pulling plan of the switch based on state of the switch; and an adjusting means configured to re-adjust pulling plan of the switch in response to a need of adjusting pulling plan of the switch.

With the switch monitoring scheme realized by the present invention, state of a switch may be identified, thus switch failure may be predicted in a line management scheme, such that different measures may be taken based on the monitored state of the switch and accidents due to switch failure may be reduced.

BRIEF DESCRIPTION OF THE DRAWINGS

Drawings referred to in the description are only for illustrating typical embodiments of the invention, and should not be considered as a limitation to the scope of the invention.

DETAILED DESCRIPTION OF THE PREFERRED EMBODIMENTS

Figure 1:
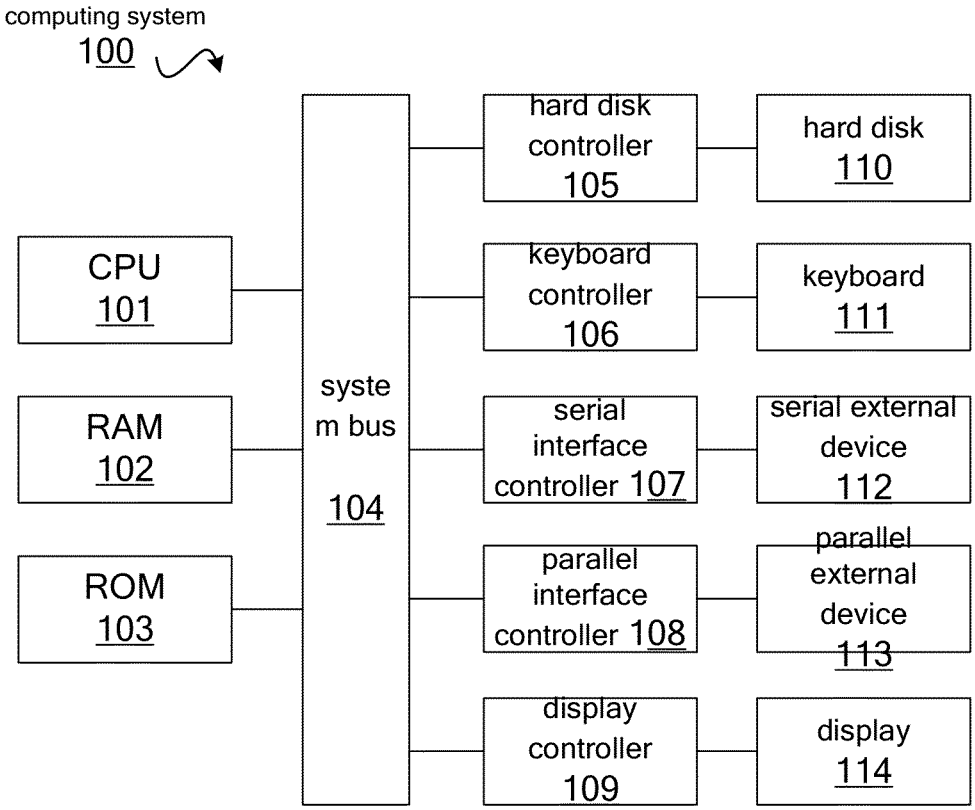
FIG. 1 shows a block diagram of an illustrative computer system adapted to implement an embodiment of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, microcode, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the users computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

FIG. 1 shows a block diagram of an illustrative computer system 100 adapted to implement an embodiment of the invention. As shown, the computer system 100 may comprise: CPU (central processing unit) 101, RAM (random access memory) 102, ROM (read only memory) 103, system bus 104, hard disk controller 105, keyboard controller 106, serial interface controller 107, parallel interface controller 108, display controller 109, hard disk 110, keyboard 111, serial external device 112, parallel external device 113 and display 114. In these devices, system bus 104 is coupled with CPU 101, RAM 102, ROM 103, hard disk controller 105, keyboard controller 106, serial interface controller 107, parallel interface controller 108, and display controller 109. Hard disk 110 is coupled with hard disk controller 105, keyboard 111 is coupled with keyboard controller 106, serial external device 112 is coupled with serial interface controller 107, parallel external device 113 is coupled with parallel interface controller 108, and display 114 is coupled with display controller 109. It should be appreciated that, the structural block diagram shown in FIG. 1 is merely for purpose of illustration, rather than for limiting scope of the invention. In some cases, certain devices may be added or removed as needed.

Inventor of the present invention discovers that, electric signal of a switch motor during pulling of the switch can effectively reflect status of the switch, when the switch is in a stable state, electric signal of its motor is very steady during pulling of the switch; however, when the switch is in an unstable state, there will be different degrees of fluctuation in electric signal of its motor during pulling of the switch, the larger the degree of fluctuation, the more unstable the status of the switch is. Therefore, status of a switch may be identified by monitoring electric signal of a switch motor, and different measures may be further taken based on different states of the switch, such as, reduce frequency of pulling the switch, not pull the switch and wait for maintenance at night by working personnel etc. With these measures, accidents due to switch failure may be effectively reduced, in addition, train delay time may also be reduced through proper line management.

Figure 2:
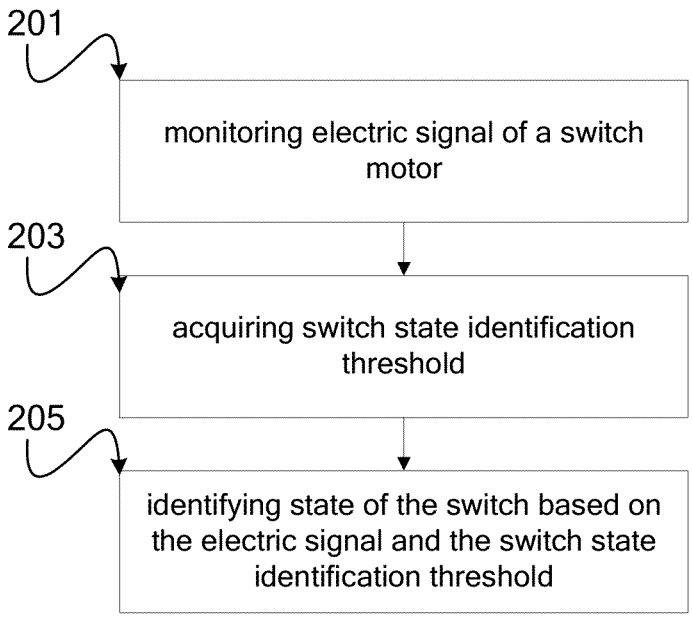
FIG. 2 shows a flowchart of a switch monitoring method according to an embodiment of the present invention.

FIG. 2 shows a flowchart of a switch monitoring method according to an embodiment of the invention. In step 201, electric signal of a switch motor is monitored; in step 203, switch state identification threshold is acquired; and in step 205, state of the switch is identified based on the electric signal and the switch state identification threshold.

Figure 5:
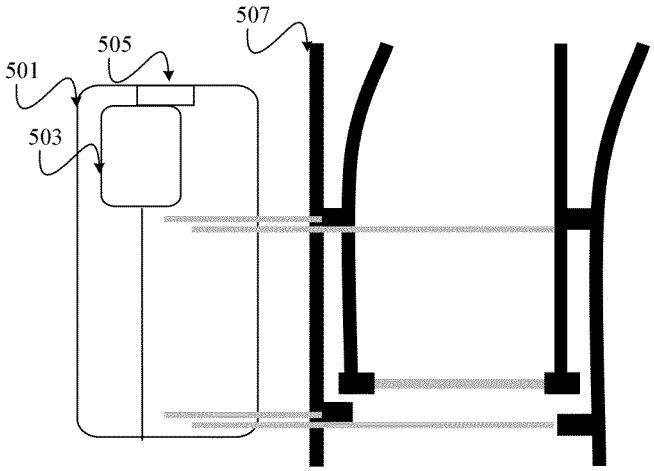
FIG. 5 shows a schematic diagram of the structure of a switch.

The monitored electric signal of a switch motor in step 201 may be one of the following electric signals: voltage value of a circuit where the switch motor locates, current value of a circuit where the switch motor locates. FIG. 5 shows a schematic diagram of the structure of a switch. 501 indicates a circuit controller of the switch, 503 indicates a motor of the switch, 507 indicates a rail of the switch. Unlike conventional switch structure, the circuit controller of the switch of the present invention also has an electric signal sensor 505 inventively installed therein. The circuit controller 501 also contains therein many other components, and for simplicity, FIG. 5 only illustrates those components that are closely related to the present invention.

In an embodiment, the electric signal sensor 505 is used to measure voltage of a circuit where the switch motor 503 locates. The present invention has no limitation as to measure voltage between which two points, as long as it is a voltage between two points in the circuit where the switch motor 503 locates. However, the standard adopted in measuring voltage during monitoring electric signal of the switch motor should be consistent with that adopted in measuring voltage during determination of the switch state identification threshold, for example, if voltage measured during determination of the switch state identification threshold is the voltage between both ends of the motor 503, then what is measured during monitoring electric signal of a switch motor should also be the voltage between both ends of the motor 503. The present description mainly takes voltage signal for example, however it does not mean that the invention is only limited to monitor voltage signal of a motor. In another embodiment, the electrical signal sensor 505 is used to measure current of a circuit where the switch motor 503 locates. Similarly, the present invention has no limitation as to measure current in which electric circuit, as long as it is current in one electric circuit of the circuit where the switch motor 503 locates. However, the standard adopted in measuring current during monitoring electric signal of the switch motor should be consistent with that adopted in measuring current during determination of the switch state identification threshold.

It should be noted that, acquiring the switch state identification threshold (step 203 in FIG. 2) and identifying state of the switch based on the electric signal and the switch state identification threshold (step 205 in FIG. 5) of the present invention may be carried out in a local processor of the switch, or be carried out on a remote server.

Returning to FIG. 2, in step 203, the switch state identification threshold is acquired. The switch state identification threshold identifies division points of a switch under different states. The switch state identification threshold may be directly acquired according to experience value, or be computed according to historical data.

According to an embodiment of the present invention, step 203 further comprises determining switch state identification threshold based on change in fluctuation degree of electric signal of same type of switch motor under different states during pulling of the switch. The switch state identification threshold may be determined by analyzing change trend of electric signal of the motor when same type of switch changes from normal operating state to failure state.

For example, according to an embodiment of the present invention, state of a switch includes first phase, second phase, and third phase. Assuming the switch can still operate normally under these three phases, that is, these three phases do not include the phase in which the switch has already failed, but the switch in the third phase is very close to failure state. In the first phase, the switch is in a stable operating state; in the second phase, the switch is in a relatively unstable operating state; and in the third phase, the switch is in a very unstable operating state.

The above division of switch state is determined based on inventor's analysis on data samples of electric signal of actual switch motor, however, the invention has no limitation as to state of a switch is divided into how many phases, for example, the invention may also be divided into two or four phases etc. More complicated phase division will result in more complicated line management, and thus higher cost.

A switch motor may generate power to control gear rotation, thereby enabling the switch to transfer from one line to another. During pulling of the switch, electric energy of the motor is converted into energy of motion for moving the switch, thus the motor will generate corresponding voltage (current). Currently, typical switch pulling is divided into three following steps: step 1 is a switch pulling procedure in which electric energy generated by the motor is converted into power for moving the switch, thus current will flow through the circuit, and duration of the whole procedure is about 2-2.5 seconds; step 2 is a switch locking procedure in which the switch has been moved into place and current switch needs to be locked, there is no energy conversion in this procedure, thus the motor will not generate current, and duration of this procedure is about 1-2 seconds; step 3 is a switch determining procedure for confirming whether the switch has been moved to proper place and fixed properly, also there is no energy conversion in this procedure, thus there is no current flowing through the motor, and duration of this procedure is about 1-2 seconds.

Figure 7A:
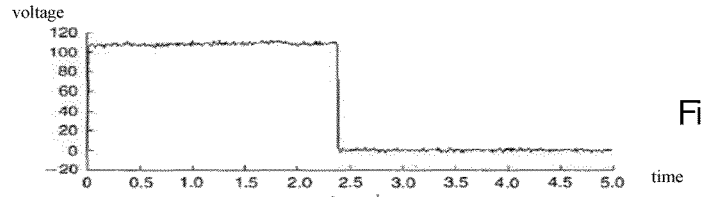
FIG. 7A shows a schematic diagram of motor voltage of a switch in a first phase.

FIG. 7A shows a schematic diagram of motor voltage of a switch in the first phase (i.e. stable operating state). The lateral axis in figure represents time, in unit of second; the vertical axis represents motor voltage, in unit of voltage V. The switch pulling procedure is from 0 to 2.4 seconds; and the switch locking procedure and switch determining procedure are from 2.4 to 5 seconds. It can be seen that, in the switch pulling procedure, motor voltage is kept at about 110V; in the switch locking procedure and switch determining procedure, motor voltage is kept at about 0V.

It is worth noting that, although the switch studied in the present embodiment is at stable operating state, and in the switch locking procedure and switch determining procedure, motor voltage is kept at about 0V; the present invention is not limited to be applied only in this condition.

Figure 7B:
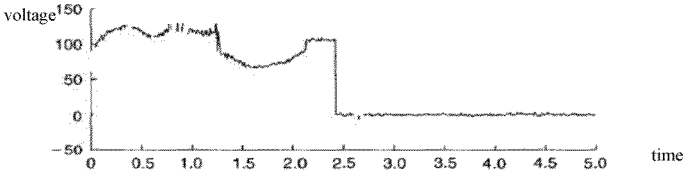
FIG. 7B shows a schematic diagram of motor voltage of a switch in a second phase.

FIG. 7B shows a schematic diagram of motor voltage of a switch in the second phase. Similarly, the lateral axis in figure represents time; the vertical axis represents motor voltage. In the second phase, the switch is in a relatively unstable operating state. In the switch pulling procedure (from 0 to 2.4 second), motor voltage fluctuates upwards or downwards; in the switch locking procedure and switch determining procedure (from 2.4 to 5 second), motor voltage is kept at about 0V.

Figure 7C:
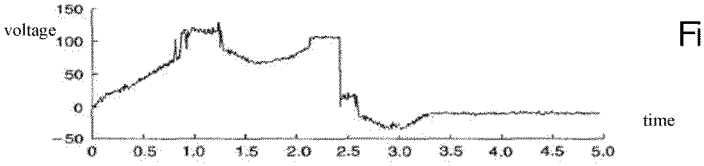
FIG. 7C shows a schematic diagram of motor voltage of a switch in a third phase.

FIG. 7C shows a schematic diagram of motor voltage of a switch in the third phase. Similarly, the lateral axis in figure represents time; the vertical axis represents motor voltage. In the third phase, the switch is in a very unstable operating state, or it can be said that although currently the switch can still operate normally, it is very likely to fail immediately. In the switch pulling procedure (from 0 to 2.4 second), motor voltage fluctuates upwards or downwards dramatically; in the switch locking procedure and switch determining procedure (from 2.4 to 5 second), there is still fluctuation in motor voltage.

Optionally, since there may be certain noise in electric signal during transmission, data signal of FIG. 7A-7C may be further de-noised, such that voltage data can reflect state of a switch more truly. Common de-noise method includes wavelet de-noising, Kalman filtering and so on.

In the example shown in FIG. 7, fluctuation degree of electric signal of the switch motor in the second phase is higher than that in the first phase, and fluctuation degree of electric signal of the switch motor in the third phase is higher than that in the second phase. In order to find out the division point between two adjacent states, that is, to determine the switch state identification threshold, motor voltage of same type of switch needs to be continuously monitored, so as to determine the switch state identification threshold through change trend of motor voltage. Next, FIG. 6 is used to describe how to utilize fluctuation degree of electric signal of a switch motor to divide different switch states.

Figure 6:
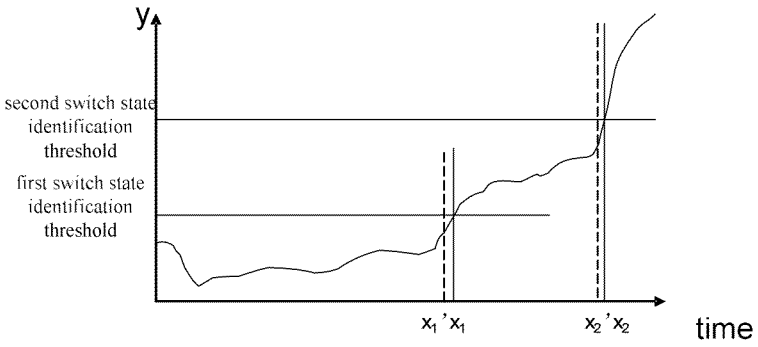
FIG. 6 shows a schematic diagram of state change of a switch.

FIG. 6 shows a schematic diagram of switch state change. The lateral axis represents usage time of a switch, the longer the usage time, the higher the fluctuation degree of the switch. The vertical axis represents fluctuation degree of electric signal of the motor (computation of which will be explained in detail below), the higher the fluctuation degree, the more unstable the switch is. It can be seen from FIG. 6 that, fluctuation degree of motor voltage has two obvious hopping in lifetime of the switch, the first hopping occurs at position where time is $X_1$, and the second hopping occurs at position where time is $X_2$, these two hopping imply that fluctuation degree of voltage of the switch motor increases significantly. Thus, fluctuation degree at $X_1$ is set as first switch state identification threshold, and fluctuation degree at $X_2$ is set as second switch state identification threshold. Since design index of different types of switch may be different, switch state identification threshold of different types of switch may also be different. To prevent jitter in fluctuation degree from generating misjudgment, the two switch state identification thresholds in FIG. 6 are not set at points from which fluctuation degree starts to jump, that is, not set at points corresponding to $X_1'$ and $X_2'$, rather, they are set at points corresponding to $X_1$ and $X_2$. In practice, the switch state identification thresholds may be set based on different needs.

Figure 3A:
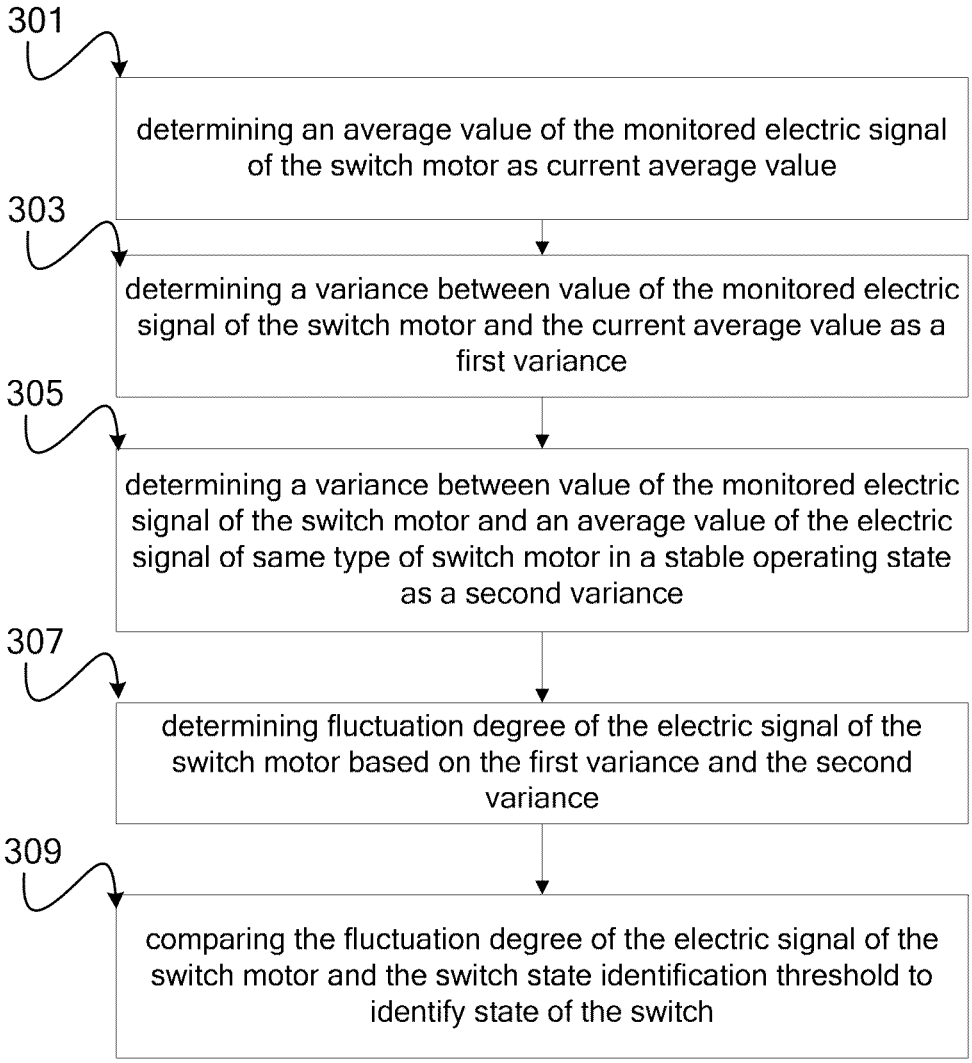
FIG. 3A shows a flowchart of a method for identifying state of a switch according to an embodiment of the present invention.

FIG. 3A shows a flowchart of a method of identifying state of a switch according to an embodiment of the invention. In step 301, an average value of the monitored electric signal of the switch motor is determined as current average value. For example, the current average value may be acquired through the following equation 1:

$$V_c=(x_1+x_2+x_3+\ldots+x_n)/n \qquad \text{Equation 1:}$$

In equation 1, $x_1, x_2 \ldots x_n$ are n voltage values of current switch motor at n time sample points. $V_c$ represents the current average value.

According to an embodiment of the present invention, the $x_1, x_2 \ldots x_n$ are voltage values of current switch motor during switch pulling procedure.

According to another embodiment of the present invention, $V_c$ is further divided into $V_{c1}$ and $V_{c2}$, in which $V_{c1}$ represents average value of voltage of current switch motor during switch pulling procedure, $V_{c2}$ represents average value of voltage of current switch motor during switch locking procedure and switch determining procedure. In a stable operating state, value of $V_{c2}$ should be 0; however, in an unstable operating state, value of $V_{c2}$ may not be 0. Equations of $V_{c1}$ and $V_{c2}$ are shown as following Equation 2 and Equation 3 respectively:

$$V_{c1}=(x_{11}\pm x_{12}+x_{13}+\ldots+x_{1n})/n \qquad \text{Equation 2:}$$

$$V_{c2}=(x_{21}+x_{22}+x_{23}+\ldots+x_{2m})/m \qquad \text{Equation 3:}$$

Wherein, $x_{11}, x_{12} \ldots x_{1n}$ represent voltage values of current switch at n sample points during switch pulling procedure, $x_{21}, x_{22} \ldots x_{2m}$ represent voltage values of current switch at m sample points during switch locking procedure and switch determining procedure.

In step 303, a variance between value of the monitored electric signal of the switch motor and the current average value is determined as a first variance $Var_1$. The first variance represents the difference between fluctuation of motor voltage of current switch and its average value. The first variance $Var_1$ may be acquired through following Equation 4.

$$Var_1=[(x_1-V_c)^2+(x_2-V_c)^2+\ldots+(x_n-V_c)^2]/n \quad \text{Equation 4:}$$

According to an embodiment of the present invention, the $x_1, x_2 \ldots x_n$ are voltage values of current switch motor during switch pulling procedure. $V_c$ represents average value of voltage of current switch motor. $Var_1$ is the first variance.

According to an embodiment of the present invention, the first variance $Var_1$ represents a variance between value of electric signal of the switch motor and the current average value during switch pulling procedure.

According to another embodiment of the present invention, the first variance $Var_1$ is further divided into $Var_{11}$ and $Var_{12}$, in which $Var_{11}$ represents a variance between voltage value of current switch motor and the current average value $V_{c1}$ during switch pulling procedure (as shown in Equation 5), $Var_{12}$ represents a variance between voltage value of current switch motor and the current average value $V_{c2}$ during switch locking procedure and switch determining procedure (as shown in Equation 6).

$$Var_{11}=[(x_{11}-V_{c1})^2+(x_{12}-V_{c1})^2+\ldots+(x_{1n}-V_{c1})^2]/n \quad \text{Equation 5:}$$

$$Var_{12}=[(x_{21}-V_{c2})^2+(x_{22}-V_{c2})^2+\ldots+(x_{2m}-V_{c2})^2]/m \quad \text{Equation 6:}$$

In Equation 5, $x_{11}, x_{12} \ldots x_{1n}$ represent voltage values of current switch at n sample points during switch pulling procedure, $x_{21}, x_{22} \ldots x_{2m}$ represent voltage values of current switch at m sample points during switch locking procedure and switch determining procedure.

In step 305, a variance between value of the monitored electric signal of the switch motor and average value of electric signal of same type of switch motor in a stable operating state is determined as a second variance $Var_2$. For convenience, average value of electric signal of same type of switch motor in a stable operating state may be referred to as standard average value $V_s$. The standard average value $V_s$ is obtained through historical data statistics.

According to an embodiment of the present invention, the standard average value $V_s$ represents average value of electric signal of same type of switch motor in a stable operating state during switch pulling procedure.

According to another embodiment of the present invention, $V_s$ is further divided into $V_{s1}$ and $V_{s2}$, in which $V_{s1}$ represents average value of voltage of same type of switch motor during switch pulling procedure, $V_{s2}$ represents average value of voltage of same type of switch motor during switch locking procedure and switch determining procedure. In a stable operating state, value of $V_{s2}$ should be 0.

According to an embodiment of the present invention, the standard average value $V_s$ may be data that is obtained and stored in advance, value of the standard average value $V_s$ only needs to be directly retrieved each time step 305 is performed.

According to another embodiment of the present invention, the flow depicted in FIG. 3A further comprises determining an average value of electric signal of same type of switch motor in a stable operating state as standard average value $V_s$ (not shown) by collecting statistics on historical data.

In step 305, magnitude of the second variance $Var_2$ represents the difference between voltage fluctuation of current switch motor and motor voltage of same type of switch in a stable operating state. In some cases (e.g., when only switch motor has failure), although value of the first variance is not large, value of the second variance may still be relatively large, which means voltage of current switch motor in general deviates from the standard average value, although fluctuation degree of voltage of current switch motor is not very large. In an embodiment, the second variance $Var_2$ may be represented by following Equation 7:

$$Var_2=[(x_1-V_s)^2+(x_2-V_s)^2+\ldots+(x_n-V_s)^2]/n \quad \text{Equation 7:}$$

In Equation 7, $x_1, x_2 \ldots x_n$ are voltage values of current switch motor at n sample points during switch pulling procedure. $V_s$ represents average value of voltage of same type of switch motor in a stable operating state.

According to an embodiment of the present invention, the second variance $Var_2$ represents a variance between value of electric signal of the switch motor and the standard average value during switch pulling procedure.

According to another embodiment of the present invention, the second variance $Var_2$ is further divided into $Var_{21}$ and $Var_{22}$, in which $Var_{21}$ represents a variance between voltage value of current switch motor and the standard average value $V_{s1}$ during switch pulling procedure (as shown in Equation 8), $Var_{22}$ represents a variance between voltage value of current switch motor and the standard average value $V_{s2}$ during switch locking procedure and switch determining procedure (as shown in Equation 9).

$$Var_{21}=[(x_{11}-V_{s1})^2+(x_{12}-V_{s1})^2+\ldots+(x_{1n}-V_{s1})^2]/n \quad \text{Equation 8:}$$

$$Var_{22}=[(x_{21}-V_{s2})^2+(x_{22}-V_{s2})^2+\ldots+(x_{2m}-V_{s2})^2]/m \quad \text{Equation 9:}$$

In step 307, fluctuation degree of electric signal of the switch motor is determined based on the first variance and the second variance. The fluctuation degree may be represented as fluctuation degree index in the following Equation 10:

$$Index=Var_1+Var_2 \quad \text{Equation 10:}$$

Further, $Var_1$, $Var_2$ in Equation 10 may be added with weight, rather than simple addition. Thus, the fluctuation degree index may reflect with emphasis different variance according to different needs. As a simplification of the invention, the fluctuation degree index "Index" may be only embodied as the first variance, so as to consider with emphasis deviation degree between voltage of current switch motor and the current average value.

According to an embodiment of the present invention, the fluctuation degree index represents fluctuation degree of electric signal of current switch motor during switch pulling procedure.

According to another embodiment of the present invention, the fluctuation degree index "Index" is further divided into $Index_1$ and $Index_2$. Wherein, $Index_1$ represents fluctuation degree of voltage of current switch motor during switch pulling procedure (as shown in Equation 11), $Index_2$ represents fluctuation degree of voltage of current switch motor during switch locking procedure and switch determining procedure (as shown in Equation 12).

$$Index_1=Var_{11}+Var_{21} \quad \text{Equation 11:}$$

$$Index_2=Var_{12}+Var_{22} \quad \text{Equation 12:}$$

Optionally, the fluctuation degree index "$Index_1$" and "$Index_2$" may be summed up with weight to obtain total fluctuation degree index. The total fluctuation degree index may be obtained through following Equation 13.

$$Index=W_1*Index_1+W_2*Index_2 \quad \text{Equation 13:}$$

Wherein, W1 and W2 represent weight.

In step 309, fluctuation degree of electric signal of the switch motor and the switch state identification threshold are compared to identify state of the switch. For example, if the fluctuation degree index is larger than the first switch state identification threshold, the current switch is considered to be in the second phase; and if the fluctuation degree index is further larger than the second switch state identification threshold, the current switch is considered to be in the third phase.

In the flow shown in FIG. 3A, step 305 may be performed before steps 301 and 303, and may also be performed after steps 301 and 303, and even may be performed simultaneously with steps 301 and 303.

Figure 3B:
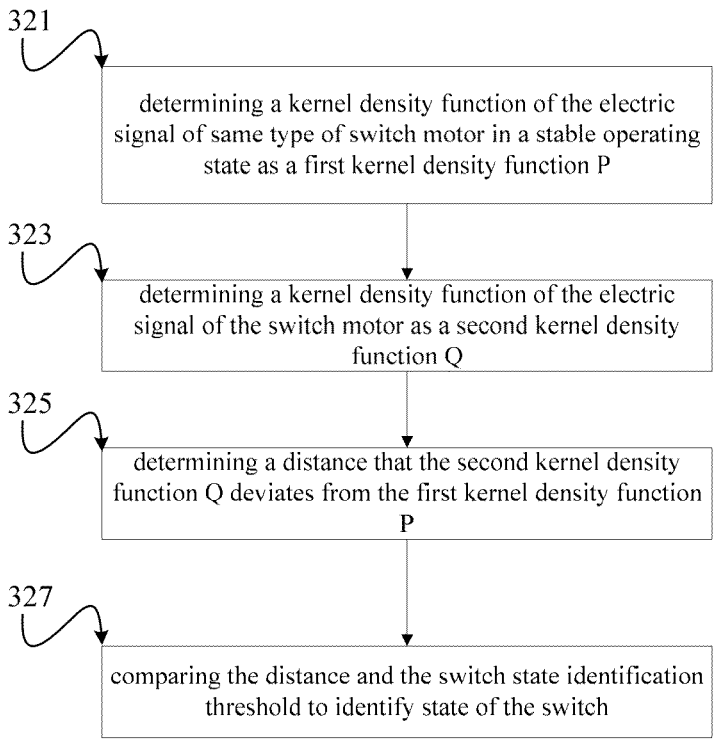
FIG. 3B shows a flowchart of a method for identifying state of a switch according to another embodiment of the present invention.

FIG. 3B shows a flowchart of a method of identifying state of a switch according to another embodiment of the present invention. In step 321, a kernel density function of electric signal of same type of switch motor in a stable operating state is determined as a first kernel density function P. The kernel density function may be acquired by kernel density estimation method, which is used to estimate unknown density function in probability theory and belongs to one of nonparametric test methods, since the kernel density estimation method belongs to existing idea, it will not be defined too much in this description. The first kernel density function may be structured as long as voltage value of sample point is known. The first kernel density function may be represented by P(Y), wherein Y represents a set of voltage values $[y_1, y_2 \ldots y_n]$ of same type of switch motor in a stable operating state.

For example, assume voltage values of a set of sample points are $y_1$=89V, $y_2$=90V, $y_3$=91V and $y_4$=90V respectively. Then, value of the first kernel density function P(Y) may be P $(y_1)$=0.25, P $(y_2)$=0.5, P $(y_3)$=0.25, P $(y_4)$=P (y1). Since probability that voltage is 89V is 25% (i.e. 0.25), probability that voltage is 90V is 50% (i.e. 0.5) and probability that voltage is 91V is 25% (i.e. 0.25), the first kernel density function P(Y) may be obtained based on values of these known points.

According to an embodiment of the present invention, the first kernel density function P(Y) is density function of same type of switch motor in a stable operating state during switch pulling procedure, wherein Y represents voltage values $[y_1, y_2 \ldots y_n]$ of same type of switch motor in a stable operating state during switch pulling procedure.

According to another embodiment of the present invention, the first kernel density function P(Y) is further divided into $P_1(Y)$ and $P_2(Y)$. Wherein, $P_1(Y)$ is density function of same type of switch motor in a stable operating state during switch pulling procedure, Y therein represents voltage values $[y_1, y_2 \ldots y_n]$ of same type of switch motor in a stable operating state during switch pulling procedure. $P_2(Y)$ is density function of same type of switch motor during switch locking procedure and switch determining procedure, Y therein represents voltage values $[y_1, y_2 \ldots y_n]$ of same type of switch motor in a stable operating state during switch locking procedure and switch determining procedure. According to an embodiment of the present invention, $P_2(0)$=100%. Since voltage of same type of switch motor in a stable operating state during switch locking procedure and switch determining procedure is 0, value of $P_2$ function at point where voltage is 0 is 100%.

In step 323, a kernel density function of electric signal of the switch motor is determined as a second kernel density function Q. The second kernel density function may be represented by Q(X), in which X represents a set of voltage values $[x_1, x_2 \ldots x_n]$ of current switch motor at n sample points.

According to an embodiment of the present invention, the second kernel density function Q(X) is kernel density function of current switch motor during switch pulling procedure, in which X represents voltage values $[x_1, x_2 \ldots x_n]$ of current switch motor during switch pulling procedure.

According to another embodiment of the present invention, the second kernel density function Q(X) is further divided into $Q_1(X)$ and $Q_2(X)$. Wherein, $Q_1(X)$ is kernel density function of current switch motor during switch pulling procedure, X therein represents voltage values $[x_1, x_2 \ldots x_n]$ of current switch motor during switch pulling procedure. $Q_2(X)$ is kernel density function of current switch motor during switch locking procedure and switch determining procedure, X therein represents voltage values $[x_1, x_2 \ldots x_m]$ of current switch motor during switch locking procedure and switch determining procedure.

In step 325, a distance that the second kernel density function Q deviates from the first kernel density function P is determined, as described in following Equation 14:

$$D(P \parallel Q) = \sum_{u \in X} P(x) \log \frac{P(x)}{Q(x)} \qquad \text{Equation 14}$$

In Equation 14, voltage value X of current switch motor, i.e. $[x_1, x_2 \ldots x_n]$ are input into the first kernel density function P, thereby acquiring value P(X) of the first kernel density function at the same sample points $[x_1, x_2 \ldots x_n]$. Further, a distance D (P||Q) that the second kernel density function Q deviates from the first kernel density function P at the same sample points $[x_1, x_2 \ldots x_n]$ is determined. The larger the value of D (P||Q), the larger the deviation of the second kernel density function Q and the first kernel density function P, that is, the larger the fluctuation degree of voltage of current switch motor The smaller the value of D (P||Q), the smaller the deviation of the second kernel density function Q and the first kernel density function P, that is, the smaller the fluctuation degree of voltage of current switch motor. Extremely, if the second kernel density function Q is completely identical with the first kernel density function P, then D (P||Q) is 0.

According to an embodiment of the present invention, the distance D (P||Q) is a distance that density function Q(X) of current switch motor deviates from density function P(X) of same type of switch motor in a stable operating state during switch pulling procedure.

According to another embodiment of the present invention, the distance D (P||Q) is further divided into $D_1$ (P||Q) and $D_2$ (P||Q). Wherein, $D_1$ (P||Q) is a distance that density function $Q_1(X)$ of current switch motor deviates from density function $P_1(X)$ of same type of switch motor in a stable operating state during switch pulling procedure. $D_2$ (P||Q) is a distance that density function $Q_2(X)$ of current switch motor deviates from density function $P_2(X)$ of same type of switch motor in a stable operating state during switch locking procedure and switch determining procedure. Distance D (P||Q) may be further represented as weighted sum of $D_1$ (P||Q) and $D_2$ (P||Q).

In step 327, the distance and the switch state identification threshold are compared to identify state of the switch. For example, if the distance is larger than the first switch state identification threshold, the current switch is considered to be in the second phase; if the distance is further larger than the second switch state identification threshold, the current switch is considered to be in the third phase.

Figure 4:
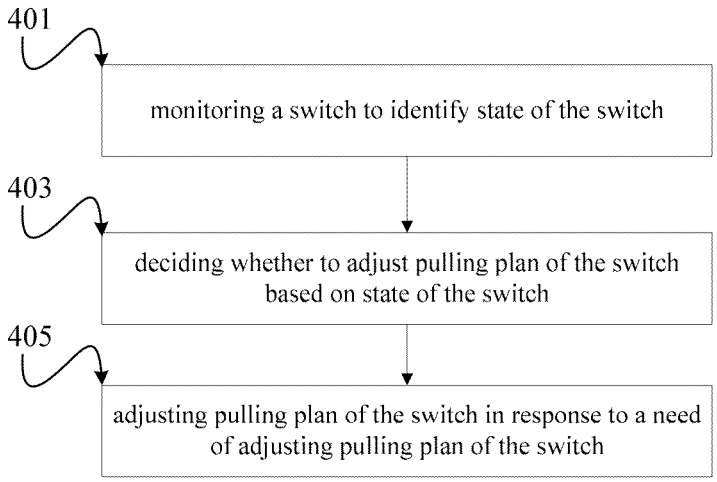
FIG. 4 shows a flowchart of performing line management according to an embodiment of the present invention.

FIG. 4 shows a flowchart of performing line management according to an embodiment of the present invention. In step 401, switch is monitored to identify state of the switch. Wherein, the method for monitoring a switch may use the method described above.

In step 403, it is decided whether to adjust pulling plan of the switch based on state of the switch. Pulling plan of a switch may comprise one or more of the following, for example: number of times (e.g., 100 times) a switch is pulled in a certain period (e.g., in a day), timetable of switch pulling (e.g., a switch is pulled at which time point in a day), how to pull a switch (e.g., a switch is pulled from straight lane to curve lane or vice versa at a certain time point) and other switch pulling plan. Some rules may be set as needed to decide whether to adjust pulling plan of a switch. For example, pulling times of a switch needs to be reduced after the switch enters into the second phase; maximum pulling times of each switch at each day should be limited within 20 (as less as possible); pulling of a switch needs to be avoided after the switch enters into the third phase, that is, if it is on straight lane, then it is kept on straight lane as it is, and if it is on curve lane, then it is kept on curve lane as it is, and for a switch that enters into the third phase, it should be repaired or replaced at night. The above rules are merely illustrative, and the present invention may utilize any other rules to decide whether to adjust pulling plan of a switch.

Figure 8A:
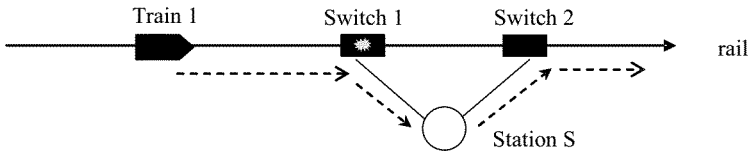
FIG. 8A shows a route map before adjusting pulling plan of a switch according to an embodiment of the present invention.
Figure 8B:
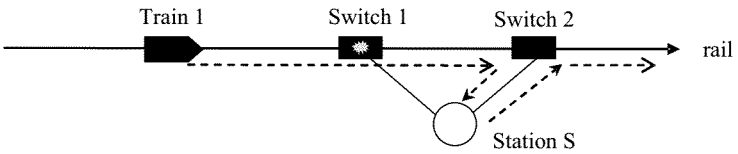
FIG. 8B shows a route map after adjusting pulling plan of a switch according to an embodiment of the present invention.

In step 405, pulling plan of the switch is re-adjusted in response to a need of adjusting pulling plan of the switch. FIG. 8A shows a route map before adjusting pulling plan of a switch according to an embodiment of the present invention. In the example shown in FIG. 8A, train 1 is intended to proceed on a rail shown by dashed line according to an original plan. Assuming that, after monitoring, switch 1 has entered into the third phase, and switch 1 is on straight lane while switch 2 is still in the first phase. According to the deciding step 403, pulling plan of switch 1 needs to be adjusted. According to step 405, pulling plan of switch 1 is re-adjusted, such that switch 1 is kept on straight lane as it is. FIG. 8B shows a route map after adjusting pulling plan of the switch according to an embodiment of the present invention. Dashed line in FIG. 8B represents the adjusted travel rail of train 1, that is, train 1 continues to go straight after passing through switch 1 and enters into station S via switch 2, then continues to proceed along rail from station S.

It is worth noting that, since travel rail of train 1 has been changed, original timetable of train 1 is likely to change therewith. Thus, according to an embodiment of the present invention, the present invention further comprises adjusting pulling plan of a switch based on delay tolerance degree of a train timetable. That is, delay degree that can be tolerated by the train is considered when adjusting pulling plan of the switch. For example, if number of times of pulling a switch that has entered into the second phase is reduced from 40 times each day to 20 times each day, it will cause 20 trains to delay 100 hours in the whole, which is economically unacceptable, therefore, pulling plan of the switch may be re-adjusted as 25 times each day etc.

According to embodiments of the present invention, state of a switch may be clearly known, and utilization plan of the switch may be further adjusted based on state of the switch, such that economic loss and human casualty due to switch failure may be avoided or reduced, meanwhile, time delay due to switch failure may also be reduced (since the present invention can issue an alert in advance before a switch actually fails, the time for repairing or replacing the switch may be arranged at night or in spare time, thereby avoiding delay due to forcing a train that travels normally to stop to wait for repairing the switch).

Under a same inventive conception, the present invention also provides a switch monitoring system. Since the switch monitoring system and the above switch monitoring method belong to a same inventive conception, same parts thereof will not be described hereinafter for brevity.

Figure 9:
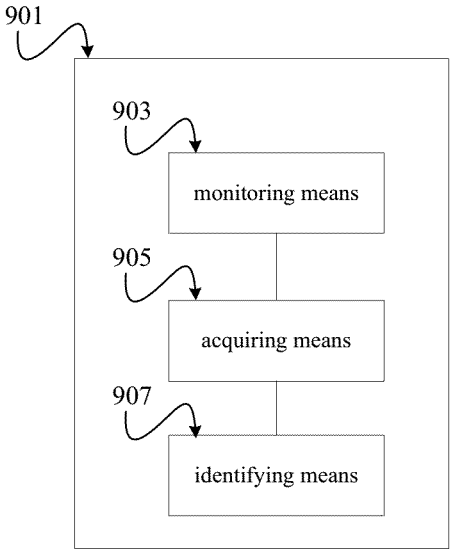
FIG. 9 shows a block diagram of a switch monitoring system according to an embodiment of the invention.

FIG. 9 shows a block diagram of a switch monitoring system 901 according to an embodiment of the invention. The switch monitoring system 901 comprises: a monitoring means 903, an acquiring means 905 and an identifying means 907. Wherein, the monitoring means 903 is configured to monitor electric signal of a switch motor. The acquiring means 905 is configured to acquire switch state identification threshold. The identifying means 907 is configured to identify state of the switch based on the electric signal and the switch state identification threshold.

According to an embodiment of the invention, the electric signal is one of the following electric signals: voltage value of a circuit where the switch motor locates, current value of a circuit where the switch motor locates.

According to an embodiment of the invention, the acquiring means 905 further comprises: a first determining means configured to determine the switch state identification threshold based on fluctuation degree of electric signal of same type of switch motor under different states.

According to an embodiment of the invention, state of the switch is divided into three phases: the switch in a first phase is in a stable operating state, the switch in a second phase is in a relatively unstable operating state, the switch in a third phase is in a very unstable operating state; and fluctuation degree of the electric signal of the switch motor in the second phase is higher than that in the first phase, fluctuation degree of the electric signal of the switch motor in the third phase is higher than that in the second phase.

Figure 10A:
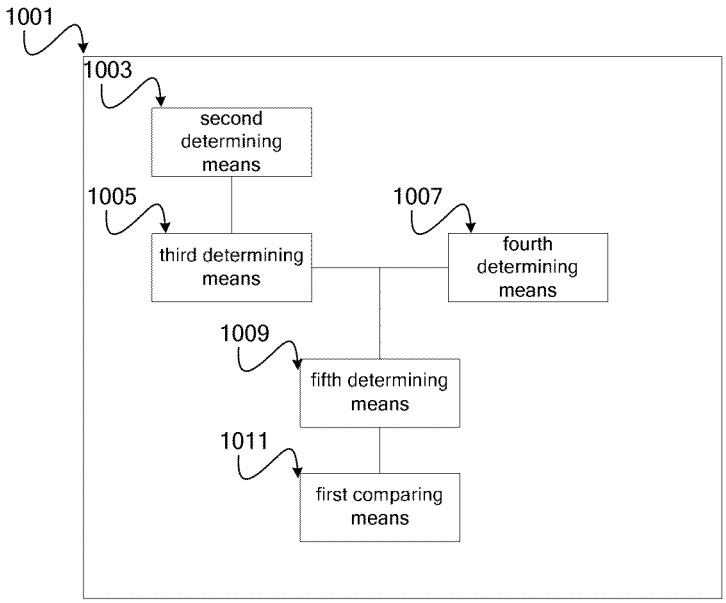
FIG. 10A shows a schematic block diagram of an identifying means according to an embodiment of the invention.

FIG. 10A shows a schematic block diagram of an identifying means 1001 according to an embodiment of the invention. Wherein, the identifying means 1001 further comprises: a second determining means 1003 configured to determine an average value of the monitored electric signal of the switch motor as current average value; a third determining means 1005 configured to determine a variance between value of the monitored electric signal of the switch motor and the current average value as a first variance; a fourth determining means 1007 configured to determine a variance between value of the monitored electric signal of the switch motor and an average value (i.e., standard average value) of the electric signal of same type of switch motor in a stable operating state as a second variance; a fifth determining means 1009 configured to determine fluctuation degree of the electric signal of the switch motor based on the first variance and the second variance; and a first comparing means 1011 configured to compare the fluctuation degree of the electric signal of the switch motor and the switch state identification threshold to identify state of the switch. Optionally, the system shown in FIG. 10A further comprises: a ninth determining means configure to determine an average value of electric signal of same type of switch motor in a stable operating state as standard average value (not shown) based on historical data statistics.

Figure 10B:
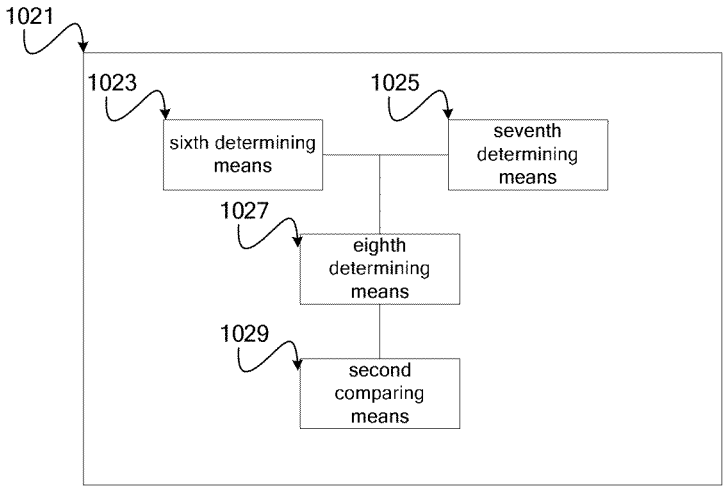
FIG. 10B shows a schematic block diagram of an identifying means according to another embodiment of the invention.

FIG. 10B shows a schematic block diagram of an identifying means according to another embodiment of the invention. According to another embodiment of the invention, the identifying means 1021 further comprises: a sixth determining means 1023 configured to determine a kernel density function of the electric signal of same type of switch motor in a stable operating state as a first kernel density function P; a seventh determining means 1025 configured to determine a kernel density function of the electric signal of the switch motor as a second kernel density function Q; an eighth determining means 1027 configured to determine a distance that the second kernel density function Q deviates from the first kernel density function P; and a second comparing means 1029 configured to compare the distance and the switch state identification threshold to identify state of the switch.

Figure 11:
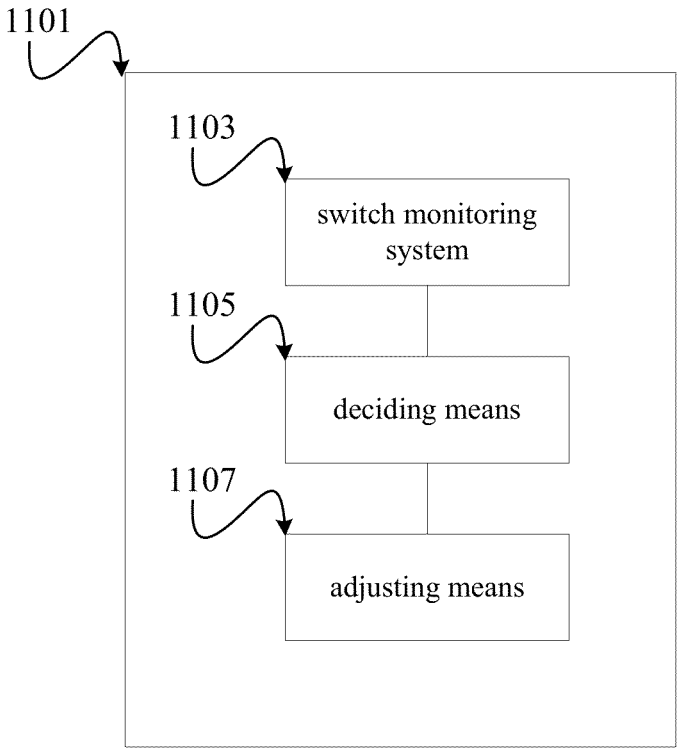
FIG. 11 shows a block diagram of a line management system according to an embodiment of the invention.

According to an embodiment of the invention, the present invention also provides a line management system, as shown in FIG. 11, the line management system 1101 comprises: the above switch monitoring system 1103; an deciding means 1105 configured to decide whether to adjust pulling plan of the switch based on state of the switch; and an adjusting means 1107 configured to re-adjust pulling plan of the switch in response to a need of adjusting pulling plan of the switch.

According to an embodiment of the invention, the adjusting means 1107 is further configured to re-adjust pulling plan of the switch based on delay tolerance degree of a train timetable.

It is worth noting that, although the present invention takes railway line for example, the present invention is not limited to monitoring switches on railway and railway line management. In fact, since application of switch is very wide, in addition to railway, the present invention may also be applied in mine road and so on. Thus, the present invention is not limited to application in railway.

Various embodiments of the invention can provide many advantages, including those that are illustrated in disclosure and those can be derived from the technical solution per se. However, they should not constitute limitation to the invention, regardless of whether one embodiment achieves all the advantages or whether such advantages are deemed as substantial improvement. Meanwhile, various embodiments described above are merely for illustration, those skilled in the art may make various modifications and changes to the above embodiments without departing from the spirit of the invention. The scope of the invention is fully defined by the appended claims.

The invention claimed is:

1. A switch monitoring system, comprising:

a monitoring means configured to monitor an electric signal of a switch motor;

an acquiring means configured to acquire a switch state identification threshold; and an identifying means configured to identify a state of the switch based on the electric signal and the switch state identification threshold, wherein the identifying means further comprises:

a second determining means configured to determine an average value of the monitored electric signal of the switch motor as a current average value;

a third determining means configured to determine a variance between a value of the monitored electric signal of the switch motor and the current average value as a first variance;

a fourth determining means configured to determine a variance between a value of the monitored electric signal of the switch motor and an average value of the electric signal of the same type of switch motor in a stable operating state as a second variance;

a fifth determining means configured to determine a fluctuation degree of the electric signal of the switch motor based on the first variance and the second variance; and a first comparing means configured to compare the fluctuation degree of the electric signal of the switch motor and the switch state identification threshold to identify the state of the switch.

2. The system according to claim 1, wherein the electric signal is one of the following electric signals: voltage value of a circuit where the switch motor locates, and current value of a circuit where the switch motor locates.

3. The system according to claim 1, wherein the acquiring means further comprises:

a first determining means configured to determine the switch state identification threshold based on a fluctuation degree of electric signal of the same type of the switch motor under different states.

4. The system according to claim 3:

wherein state of the switch is divided into three phases: (i) the switch in a first phase is in a stable operating state, (ii) the switch in a second phase is in a relatively unstable operating state, and (iii) the switch in a third phase is in a very unstable operating state;

wherein the fluctuation degree of the electric signal of the switch motor in the second phase is higher than that in the first phase; and wherein the fluctuation degree of the electric signal of the switch motor in the third phase is higher than that in the second phase.

5. The system according to claim 1 further comprising:

a deciding means configured to decide whether to adjust a pulling plan of the switch based on a state of the switch; and an adjusting means configured to adjust the pulling plan of the switch in response to a need of adjusting the pulling plan of the switch.

6. The system according to claim 5, wherein the adjusting means is further configured to adjust the pulling plan of the switch based on delay tolerance degree of a train timetable.

7. A switch monitoring system, comprising:

a monitoring means configured to monitor an electric signal of a switch motor;

an acquiring means configured to acquire a switch state identification threshold; and an identifying means configured to identify a state of the switch based on the electric signal and the switch state identification threshold, wherein the identifying means further comprises:

a sixth determining means configured to determine a kernel density function of the electric signal of the same type of switch motor in a stable operating state as a first kernel density function P;

a seventh determining means configured to determine a kernel density function of the electric signal of the switch motor as a second kernel density function Q;

an eighth determining means configured to determine a distance that the second kernel density function Q deviates from the first kernel density function P; and a second comparing means configured to compare the distance and the switch state identification threshold to identify the state of the switch.

8. The system according to claim 7, wherein the electric signal is one of the following electric signals: voltage value of a circuit where the switch motor locates, and current value of a circuit where the switch motor locates.

9. The system according to claim 7, wherein the acquiring means further comprises:

a first determining means configured to determine the switch state identification threshold based on a fluctuation degree of electric signal of the same type of the switch motor under different states.

10. The system according to claim 9:

wherein state of the switch is divided into three phases: (i) the switch in a first phase is in a stable operating state, (ii) the switch in a second phase is in a relatively unstable operating state, and (iii) the switch in a third phase is in a very unstable operating state;

wherein the fluctuation degree of the electric signal of the switch motor in the second phase is higher than that in the first phase; and wherein the fluctuation degree of the electric signal of the switch motor in the third phase is higher than that in the second phase.

11. The system according to claim 7 further comprising:

a deciding means configured to decide whether to adjust a pulling plan of the switch based on a state of the switch; and an adjusting means configured to adjust the pulling plan of the switch in response to a need of adjusting the pulling plan of the switch.

12. The system according to claim 11, wherein the adjusting means is further configured to adjust the pulling plan of the switch based on delay tolerance degree of a train timetable.

13. A computer readable non-transitory article of manufacture tangibly embodying computer readable instructions which, when executed, cause a computer to carry out the steps of a method comprising:

monitoring an electric signal for a switch motor;

acquiring a switch state identification threshold; and identifying a state of the switch based on the electric signal and the switch state identification threshold, wherein identifying the state of the switch based on the electric signal and the switch state identification threshold further comprises:

determining an average value of the monitored electric signal of the switch motor as a current average value;

determining a variance between a value of the monitored electric signal of the switch motor and the current average value as a first variance;

determining a variance between a value of the monitored electric signal of the switch motor and an average value of the electric signal of same type of switch motor in a stable operating state as a second variance;

determining a fluctuation degree of the electric signal of the switch motor based on the first variance and the second variance; and comparing the fluctuation degree of the electric signal of the switch motor and the switch state identification threshold to identify the state of the switch.

14. The computer readable non-transitory article of manufacture according to claim 13, wherein the electric signal is one of the following electric signals: a voltage value of a circuit where the switch motor locates, and a current value of a circuit where the switch motor locates.

15. The computer readable non-transitory article of manufacture according to claim 13, wherein acquiring the switch state identification threshold further comprises:

determining the switch state identification threshold based on a fluctuation degree of an electric signal of the same type of switch motor under a plurality of different states.

16. The computer readable non-transitory article of manufacture according to claim 15:

wherein the state of the switch is divided into three phases: (i) the switch in a first phase is in a stable operating state, (ii) the switch in a second phase is in a relatively unstable operating state, and (iii) the switch in a third phase is in a very unstable operating state;

wherein a fluctuation degree of the electric signal of the switch motor in the second phase is higher than that in the first phase; and wherein a fluctuation degree of the electric signal of the switch motor in the third phase is higher than that in the second phase.

17. The computer readable non-transitory article of manufacture according to claim 13, the method further comprising:

deciding whether to adjust a pulling plan of the switch based on the state of the switch; and adjusting the pulling plan of the switch in response to a need of adjusting the pulling plan of the switch.

18. The computer readable non-transitory article of manufacture according to claim 17, wherein adjusting the pulling plan of the switch further comprises:

adjusting the pulling plan of the switch based on a delay tolerance degree of a train timetable.

19. A computer readable non-transitory article of manufacture tangibly embodying computer readable instructions which, when executed, cause a computer to carry out the steps of a method comprising:

monitoring an electric signal for a switch motor;

acquiring a switch state identification threshold; and identifying a state of the switch based on the electric signal and the switch state identification threshold, wherein identifying the state of the switch based on the electric signal and the switch state identification threshold further comprises:

determining a kernel density function of the electric signal of the same type of switch motor in a stable operating state as a first kernel density function P;

determining a kernel density function of the electric signal of the switch motor as a second kernel density function Q;

determining a distance that the second kernel density function Q deviates from the first kernel density function P; and comparing the distance and the switch state identification threshold to identify the state of the switch.

20. The computer readable non-transitory article of manufacture according to claim 19, wherein the electric signal is one of the following electric signals: a voltage value of a circuit where the switch motor locates, and a current value of a circuit where the switch motor locates.

21. The computer readable non-transitory article of manufacture according to claim 19, wherein acquiring the switch state identification threshold further comprises:

determining the switch state identification threshold based on a fluctuation degree of an electric signal of the same type of switch motor under a plurality of different states.

22. The computer readable non-transitory article of manufacture according to claim 21:

wherein the state of the switch is divided into three phases: (i) the switch in a first phase is in a stable operating state, (ii) the switch in a second phase is in a relatively unstable operating state, and (iii) the switch in a third phase is in a very unstable operating state;

wherein a fluctuation degree of the electric signal of the switch motor in the second phase is higher than that in the first phase; and wherein a fluctuation degree of the electric signal of the switch motor in the third phase is higher than that in the second phase.

23. The computer readable non-transitory article of manufacture according to claim 19, the method further comprising:

deciding whether to adjust a pulling plan of the switch based on the state of the switch; and adjusting the pulling plan of the switch in response to a need of adjusting the pulling plan of the switch.

24. The computer readable non-transitory article of manufacture according to claim 23, wherein adjusting the pulling plan of the switch further comprises:

adjusting the pulling plan of the switch based on a delay tolerance degree of a train timetable.

* * * * *